US006220895B1

(12) United States Patent
Lin

(10) Patent No.: US 6,220,895 B1
(45) Date of Patent: Apr. 24, 2001

(54) SHIELDED ELECTRICAL CONNECTOR

(75) Inventor: Cheng-Te Lin, Taipei Hsien (TW)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/078,011

(22) Filed: May 13, 1998

(30) Foreign Application Priority Data

May 16, 1997 (CH) ..... 86207969

(51) Int. Cl.[7] ..... H01R 13/00
(52) U.S. Cl. ..... 439/607; 439/607
(58) Field of Search ..... 439/607–610, 439/101, 108

(56) References Cited

U.S. PATENT DOCUMENTS

| | | | | |
|---|---|---|---|---|
| 5,254,010 | | 10/1993 | Davis | 439/108 |
| 5,266,038 | * | 11/1993 | Nakamura | 439/607 |
| 5,338,215 | * | 8/1994 | Lee et al. | 439/607 |
| 5,378,172 | * | 1/1995 | Roberts | 439/607 |
| 5,518,421 | * | 5/1996 | Davis | 439/607 |
| 5,637,015 | | 6/1997 | Tan et al. | 439/607 |
| 5,702,271 | | 12/1997 | Steinman | 439/676 |
| 5,797,770 | * | 8/1998 | Davis et al. | 439/607 |

FOREIGN PATENT DOCUMENTS

| | | | |
|---|---|---|---|
| 0 497 165 A1 | 8/1992 | (EP) | H01R/13/658 |
| 0 524 426 A1 | 1/1993 | (EP) | H01R/13/658 |
| 1-72752 | 5/1989 | (JP) | H01R/13/648 |
| 2-30076 | 1/1990 | (JP) | H01R/13/648 |
| 3-131074 | 12/1991 | (JP) | H01R/13/648 |
| 5-152031 | 6/1993 | (JP) | H01R/13/658 |
| 7-16312 | 4/1995 | (JP) | H01R/13/648 |
| 07220815 | 8/1995 | (JP) | H01R/13/648 |
| 8-106961 | 4/1996 | (JP) | H01R/17/04 |
| 8-222324 | 8/1996 | (JP) | H01R/13/648 |
| WO 97/10628 | 3/1997 | (WO) | H01R/23/68 |

* cited by examiner

*Primary Examiner*—Hien Vu
(74) *Attorney, Agent, or Firm*—Robert J. Zeitler

(57) ABSTRACT

A shielded electrical connector includes a housing formed as a generally rectangular unitary hollow block made of an insulator material, and a shielding member made from a punched conductive metal blank is mounted on the housing to provide protection against electromagnetic interference. Conductive latches for engaging a shield of a mating connector extend along and are supported by side wall portions of the shield.

19 Claims, 6 Drawing Sheets

SHIELDED ELECTRICAL CONNECTOR

BACKGROUND OF THE INVENTION

The invention relates to a shielded electrical connector, more particularly to an electrical connector with a shielding member that is capable of providing effective protection against electromagnetic interference.

Connectors are often used for signal transmission among the various electrical components in a computer. Referring to FIG. 1, a conventional electrical connector is shown to include a generally rectangular housing 10 made of an insulator material. The housing 10 has a front side formed with a receiving chamber 101 and a socket 102 formed in the receiving chamber 101. The socket 102 has contact insert holes 103 for electrically and mechanically engaging a complementary electrical connector (not shown). A plurality of terminals 104 are disposed in the insert holes 103, respectively, and have tips that extend downwardly from the bottom side of the housing 10 for electrical connection with a circuit board (not shown). The electrical connector further includes a shielding unit to prevent external electromagnetic waves from interfering and affecting signal quality during signal transmission.

The shielding unit includes first and second shielding components 20, 25 that cover the housing 10. The first shielding component 20 includes top, rear, left and right wall portions 21, and covers four sides of the housing 10 (excluding the front side and the bottom side). The bottom edge of the first shielding component 20 is formed with grounding legs 22 for grounding purposes. The second shielding component 25 has two sides formed with a respective thorn 251 for fixing the second shielding component 25 in a space formed between the inner wall surface of the receiving chamber 101 and the socket 102. The bottom edge of the second shielding component 25 is also formed with a grounding leg 252 for grounding purposes.

It is noted that the protection against electromagnetic interference in the aforementioned conventional electrical connector is inadequate since no shielding effect is provided at the front side of the socket 102.

FIG. 2 illustrates another conventional electrical connector with a shielding unit. As shown, the electrical connector includes a generally rectangular housing 10' made of an insulator material. Like the housing 10 of the electrical connector of FIG. 1, the housing 10' has a front side formed with a receiving chamber 101', and a socket 102' formed in the receiving chamber 101'. The socket 102' has contact insert holes 103' for engaging electrically and mechanically a complementary electrical connector (not shown). A plurality of terminals (not shown) are disposed in the insert holes 103', respectively, and have tips that extend downwardly from the bottom side of the housing 10' for electrical connection with a circuit board (not shown). The left and right sides of the housing 10' are formed with a respective fastening recess 105. The electrical connector further includes a shielding unit to prevent external electromagnetic waves from interfering and affecting signal quality during signal transmission.

The shielding unit is similar to that disclosed in U.S. Pat. No. 5,637,015 issued on Jun. 10, 1997 to Hon Hai Precision Ind. Co., Ltd., and includes first and second shielding components 30, 35 that cover the housing 10'. The first shielding component 30 includes a front wall portion 31 and left and right wall portions 32. The front wall portion 31 is formed with a circular opening 311, and a rearwardly extending guide piece 312 at the periphery of the opening 311. The top edge of the front wall portion 31, is bent rearward to form a press section 313. Each of the left and right wall portions 31 has an engaging section 321 that is formed with a slit 3211. The top edge of each of the left and right wall portions 32 is formed with a stepped section 322. The bottom edge of each of the left and right wall portions 32 is formed with a downwardly extending grounding leg 323. The second shielding component 35 includes a top wall portion 351 and a rear wall portion 352. The rear wall portion 352 has forwardly projecting insert section 353 at left and right edges thereof. Each insert section 353 has a resilient piece 354 thereon. The front edge of the top wall portion 351 is formed with a stepped section 355. The left and right edges of the top wall portion 351 are bent downwardly to form a respective press section 356.

The first shielding component 30 is mounted on the housing 10' at the front side of the latter so as to cover and be positioned on the front side and the left and right sides of the housing 10'. The second shielding component 35 is mounted on the housing 10' at the rear side of the same so as to cover and be positioned on the top and rear sides of the housing 10'.

The front wall portion 31 of the first shielding component 30 provides the electrical connector of FIG. 2 with stronger protection against electromagnetic interference than that in the electrical connector of FIG. 1. However, the electrical connector of FIG. 2 still has an unsatisfactory design due to the following reasons: From the manufacturer's viewpoint, there is a need to form two separate components; i.e., the first shielding component 30 with the front wall portion and the left and right wall portions, and the second shielding component 35 with the top and rear wall portions. During the manufacturing stage, the two components undergo separate processing operations. Particularly, two dies must be prepared when forming the two components. For each mold, the precision of the corners in the other mold must be taken into consideration. Furthermore, the corresponding angles of the press sections 313, 356 and the stepped sections 322, 355 that project from the edges of the two shielding components must be precisely matched. The high quality requirement during the die forming and production stages is troublesome and results in increased costs. In addition, because the two shielding components are mounted on the housing one after the other, and because the shapes of the shielding components have been set beforehand, extreme care must be undertaken when bending the different portions of the shielding components during the mounting of the same so as to avoid any deviation which can hinder precise mounting of the shielding components on the housing. This increases the difficulty in mounting the shielding components on the housing. Moreover, clearances between the shielding components cannot be entirely avoided when the shielding components are mounted on the housing. These clearances can have an adverse effect on the protection against electromagnetic interference.

SUMMARY OF THE INVENTION

Therefore, the main object of the present invention is to provide an electrical connector with a shielding member that is relatively convenient to assemble and that is capable of providing effective protection against electromagnetic interference.

Another object of the present invention is to provide an electrical connector with a shielding member that is relatively convenient to fabricate.

Accordingly, the shielded electrical connector of this invention electrical connector comprises a conductive shield including two side wall portions, a top wall portion and a front wall portion. The front wall portion has insert aperture for receiving a mating connector. The shield receives an insulative housing having a top side, a bottom side and a contact mounting member disposed in the shield to be accessible through the insert aperture in the front wall portion of the shield. Contacts are mounted in the housing with a mating portion disposed in the contact mounting member for engaging contacts of the mating connector. A conductive latch is unitarily supported by one of the side wall portions and extends along the contact mounting member for contacting a shield of the mating connector.

The housing of the shielded electrical connector preferably includes side walls extending from the top side to the bottom side. The side walls of the housing are disposed inwardly of the side wall portions of the shield. One of the side walls includes a notch for receiving the conductive latch. The two side wall portions and the front wall portion preferably unitarily depend from the top wall portion of the shield. The shield also preferably includes a rear wall portion unitarily depending from the top wall portion.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
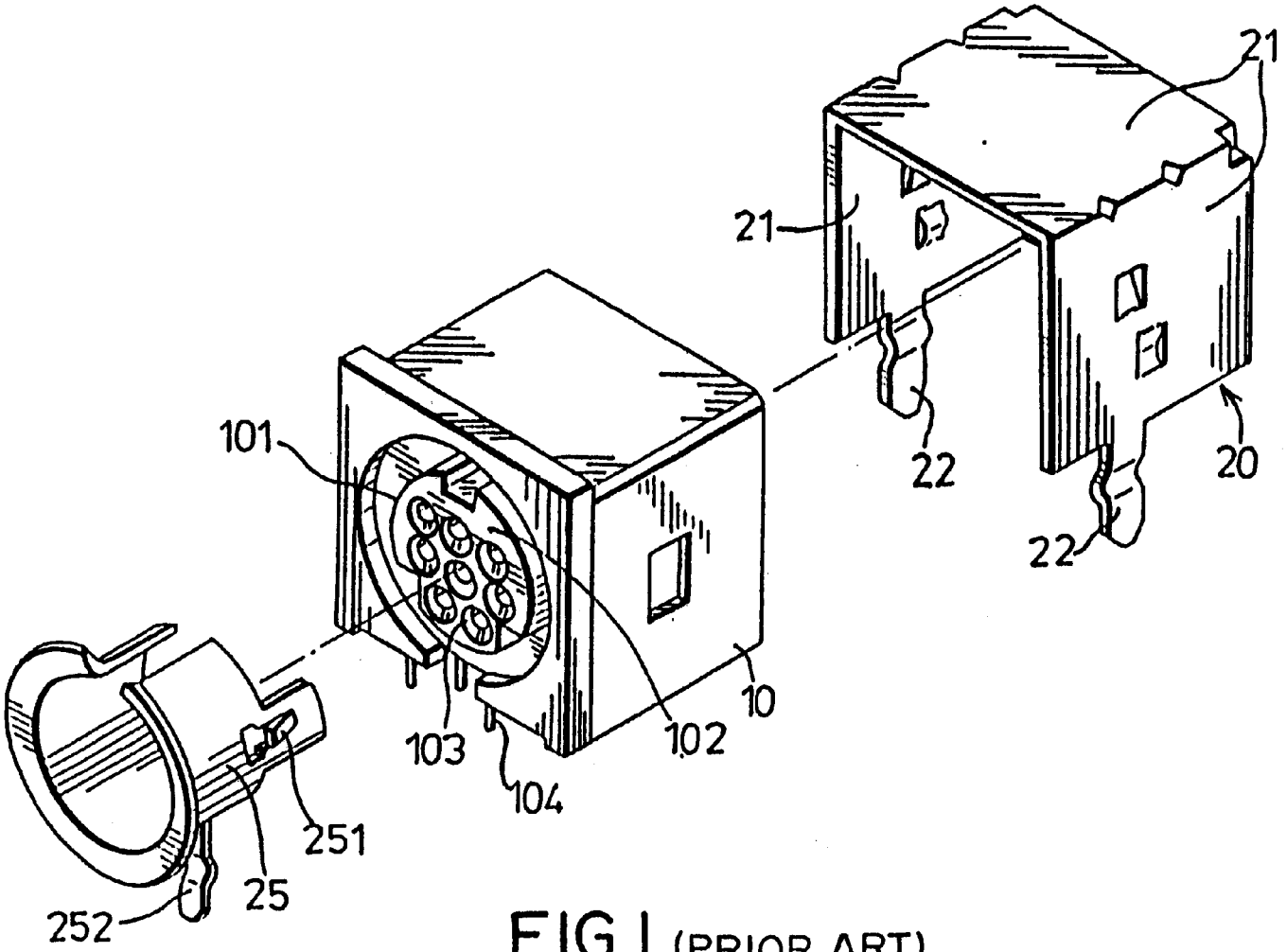
FIG. 1 (PRIOR ART)
FIG. 1 is an exploded view of a conventional shielded electrical connector.
Figure 2:
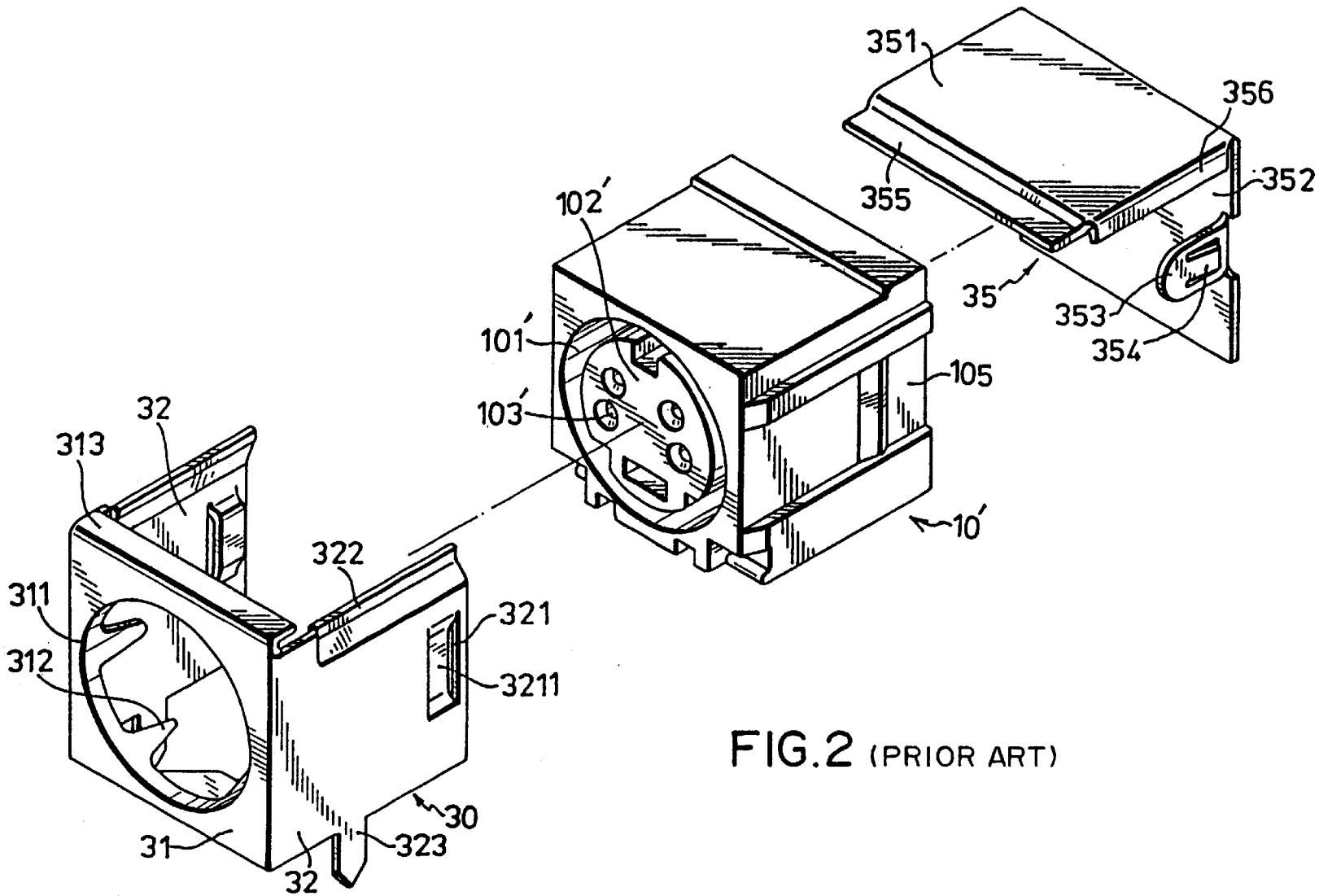
FIG. 2 (PRIOR ART)
FIG. 2 is an exploded view of another conventional shielded electrical connector.
Figure 3:
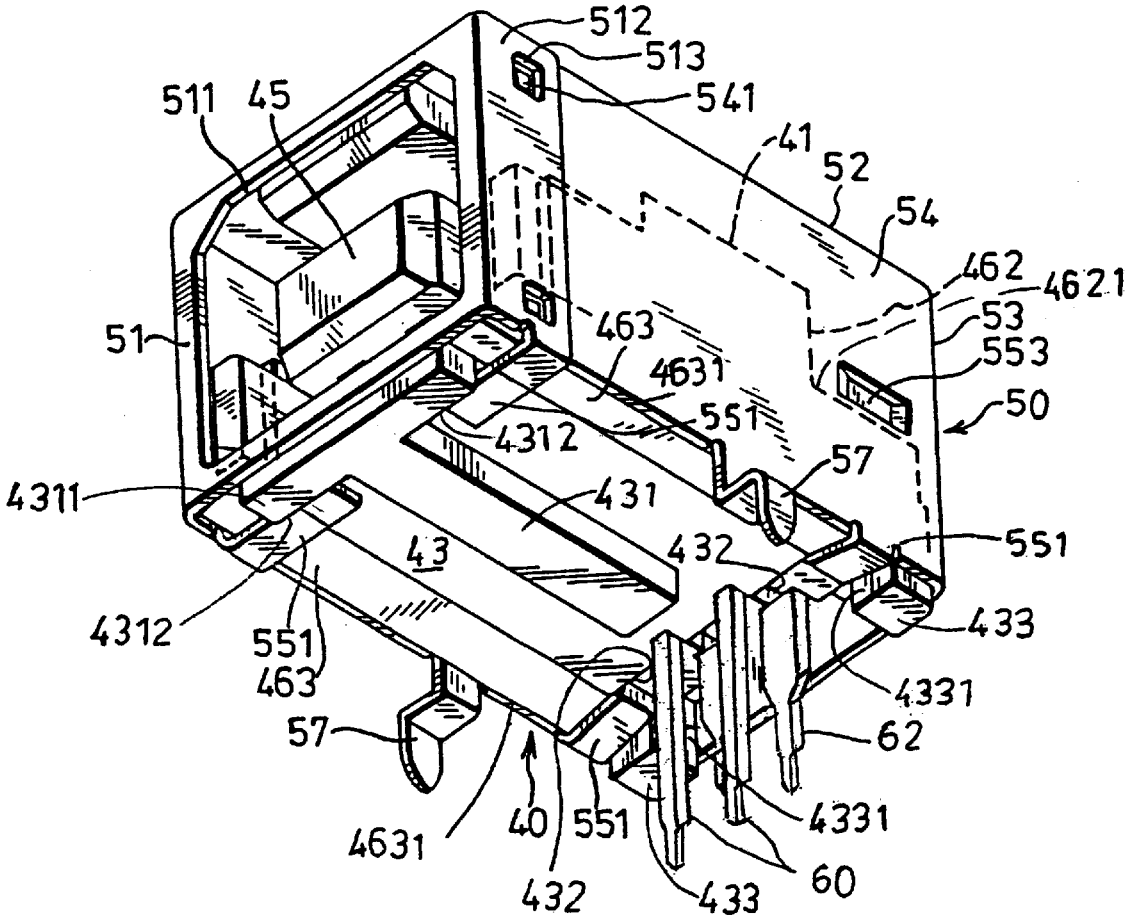
FIG. 3 is a perspective view of the preferred embodiment of a shielded electrical connector according to the present invention.
Figure 4:
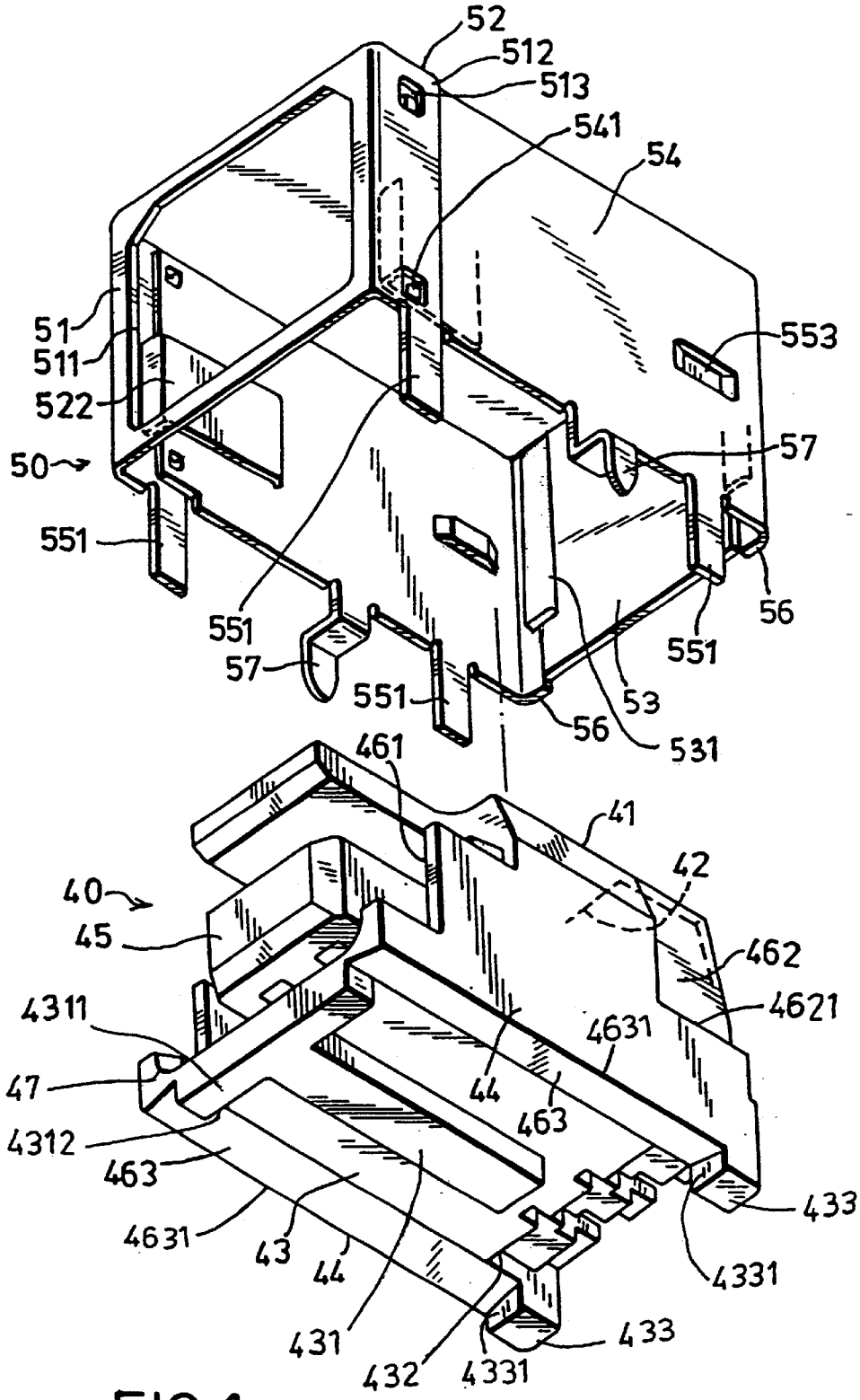
FIG. 4 is an exploded view of the preferred embodiment with terminal:; removed.
Figure 5:
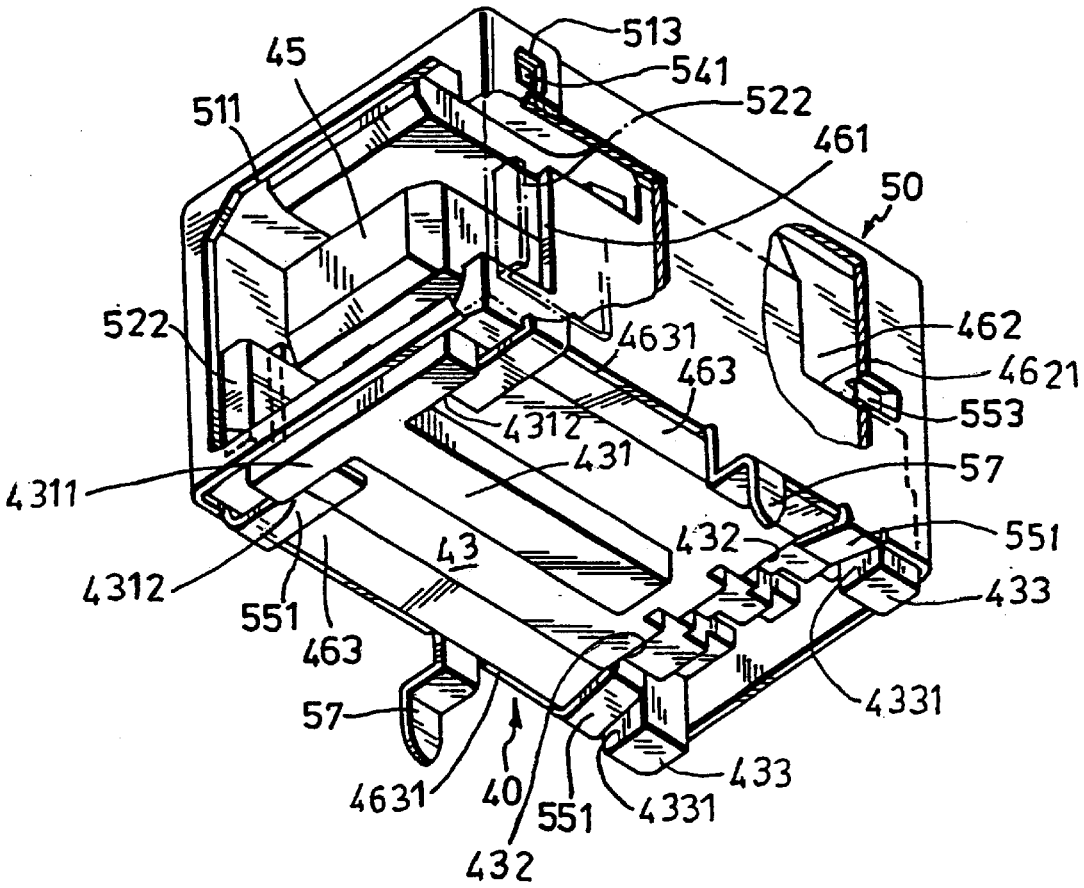
FIG. 5 is a perspective, partly cut away view of the preferred embodiment with terminals removed.

Referring to FIGS. 3, 4 and 5, the preferred embodiment of a shielded electrical connector according to the present invention is shown to comprise a housing 40 and a one-piece integrally formed shielding member 50. Contacts 60, 62 are mounted on the housing as shown in FIG. 3. The contacts 60, 62 are removed in FIGS. 4 and 5 for illustrative purposes.

The housing 40 is formed as a generally rectangular unitary hollow block made of an insulator material, and has a top side 41, a rear side 42, a bottom side 43, left and right sides 44 and a front side 47. The housing 40 further has a contact mounting member 45 formed therein and accessible via the front side of the housing 40. The contact mounting member 45 is adapted for mating with a complementary electrical connector (not shown) in a conventional manner. In the present embodiment, the left and right sides 44 of the housing 40 are formed with left and right latching notches 461 adjacent to the front side, and left and right recesses 462 adjacent to the rear side 42. The bottom side 43 has left and right ramps 463 obtusely angled with respect to the bottom side 43 to define a corner 4631 with a respective side 44. The bottom side 43 of the housing 40 is formed with a T-shaped standoff 431 and a recessed rear edge 432 between the rear end of the ramps 463 and the rear standoffs 433. The T-shaped standoff 431 has a crossbar 4311 defining a rearward surface 4312. The rear standoffs, 433 define a forward surface 4331.

The shielding member 50 is made by stamping and forming a conductive metal blank, as discussed in detail subsequently, and is mounted on the housing 40 to provide protection against electromagnetic interference. The shielding member 50 includes a top wall portion 52, a front wall portion 51, a rear wall portion 53, and left and right wall portions 54 disposed adjacent to the top side 41, the front side 47, the rear side 42 and the left and right sides 44 of the housing 40, respectively. The front wall portion 51 is formed with an insert aperture 511 for exposing the contact mounting member 45. Left and right flanges 512 are connected respectively to the left and right edges of the front wall portion 51. Two apertures 513 are formed in each of the left and right flanges 512. The left and right flanges 512 are folded toward the front edge part of a respective one of the left and right wall portions 54. Two protrusions 541 are formed on the front edge part of each of the left and right wall portions 54 to engage the apertures 513 on the left and right flanges 512. The protrusions 541 and the left and right flanges 512 constitute a first retaining device for engaging the left and right edges of the front wall portion 51 with the front edge parts of the left and right wall portions 54.

Each of the front wall portions 51 and the left and right wall portions 54 has a bottom edge formed with at least one fastening strip 551. In this embodiment, the front wall portion 51 has two fastening strips 551 that extend from the left and right flanges 512. The fastening strips 551 are folded toward the bottom side 43 of the housing 40 such that the fastening strips 551 abut firmly against the corner 4631 on the bottom side 43 at the ramps 463. The ramps 463 are inclined to allow the strips 551 to be overformed.

Left and right resilient latch strips 522 are disposed on inner wall surfaces of the left and right wall portions 54, and are connected unitarily to the front edges of the left and right wall portions 54, respectively. The left and right latching notches 461 define a space that receives the left and right resilient latch strips 522, respectively. The left and right resilient latch strips 522 are conductive for grounding to a shield of a mating connector (not shown) and catching behind a boss on a mating connector to latch a mating connector into a mating engagement (not shown). Left and right inward protrusions 553 are further formed on the inner wall surfaces at rear edges of the left and right wall portions 54, respectively. The left and right recesses 462 in the housing engage the left and right protrusions 553, respectively. The latch strips 522, the protrusions 553, that latching notches 461 and the recesses 462 cooperatively form a second retaining device for engaging the left and right wall portions 54 of the shielding member with the left and right sides 44 of the housing 40.

Rear flanges 56 are connected respectively to the rear edges of the left and right wall portions 54 and are folded toward the left and right edges of the rear wall portion 53, respectively. The rear flanges 56 serve as a third retaining device. Lower portions of the left and right edges of the rear wall portion 53 engage inwardly turned edges of rear flanges 56 of the left and right wall portions 54. Upper portions of the rear wall portion 53 are formed with restraining strips 531 that are bent forwardly and outwardly in front of the respective rear flange 56. The restraining strips 531 prevent flanges 56 from moving excessively forwardly. The bottom edge of each of the left and right wall portions 54 is further formed with a downwardly extending mounting leg 57 for mounting on a circuit board (not shown).

Figure 6:
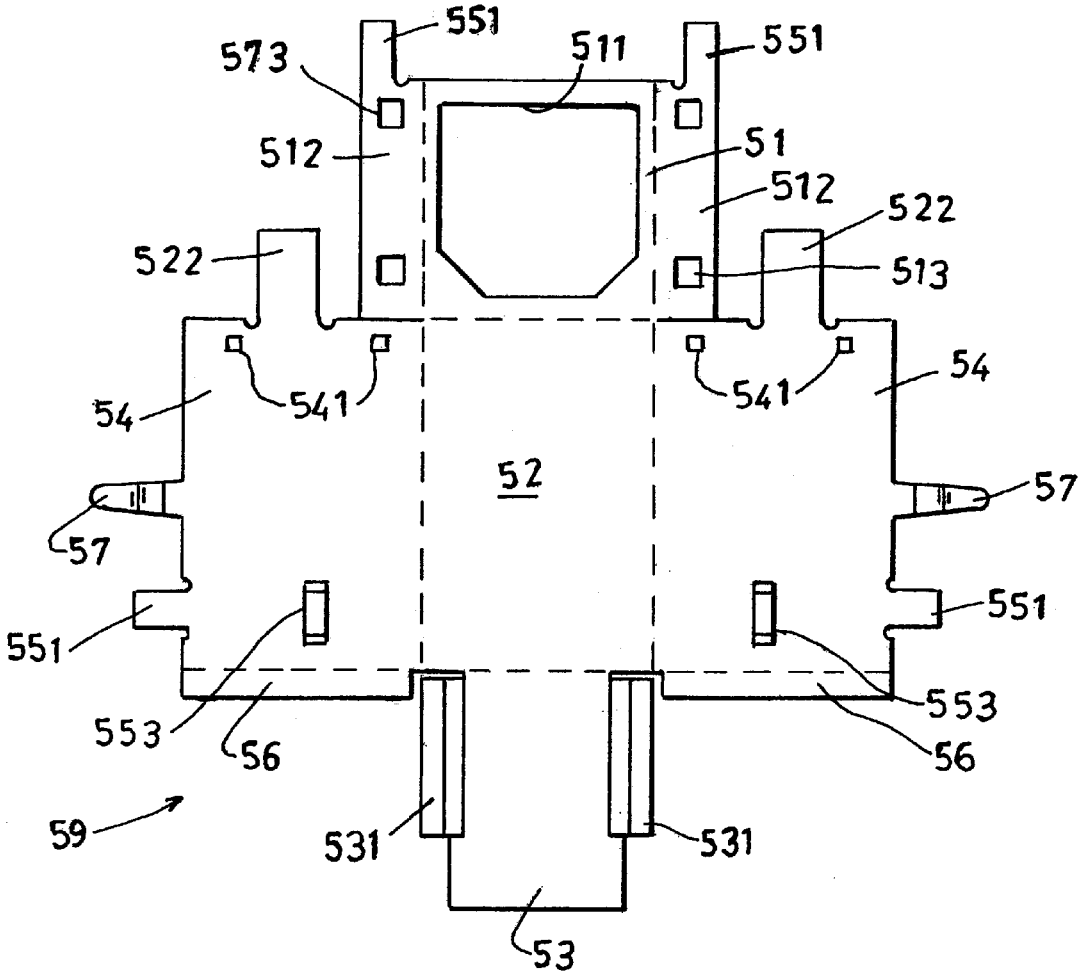
FIG. 6 is a plan view of the blank of the metal shield for fabricating the shielded electrical connection.

The electrical connector is made by stamping a metal blank 59 to form the shield 50 from a metal sheet. As shown in FIG. 6, the blank 59 defines the front wall portion 51 with the opening 511 therein and the two flanges 512 with apertures 513 and forward fastening strips 551. The blank 59 also defines two opposing side wall portions 54 each with the latch strip 522 extending from a front edge, the rearward fastening strip 551 and the mounting leg 57 extending from a lower edge of each wall portion 54 and rear flanges 56. The blank further defines a rear wall portion 53 with retaining strips 531 extending from side edges of the rear wall portion 53. The front wall portion 51, the side wall portions 54 and the rear wall portion 53 all radially extend from the top wall portion 52.

The retention strips 531 are bent forwardly and outwardly from the outer edges of the rear wall portion 53. The mounting legs 57 are bent into the final configuration. Indentations 553 and protrusions 541 are stamped into the side wall portions 54. The latching strips 522 are folded back to oppose an inner surface of the respective side wall portion 54. The front wall portion 51 and the opposing side wall portions 54 are orthogonally folded with respect to said top wall portion 52. The flanges 512 are folded over the side wall portions 54, and the apertures 513 receive protrusions 541. The rear wall portion 53 is folded downwardly and the rear flanges 56 are folded inwardly to engage restraining strips 531.

To complete the assembly, the contact 60, 62 are loaded into the housing 40, and the housing 40 is inserted into the shield 50. The latching strips 522 are received in notches 461 and indentations 553 are received into recesses 462. The fastening strips 551 are bent under and around corners 4631 and against ramps 463 and bottom wall 43.

After assembly referring to FIGS. 3–5, the rear flanges 56 engage the left and right edges of the rear wall portion 53, and the shielding member 50 is capped on the housing 40 such that the top wall portion 52, the front wall portion 51, the rear wall portion 53, and the left and right wall portions 54 are closely adjacent to the top side 41, the front side 47, the rear side 42 and the left and right sides 44 of the housing 40, respectively. The left and right latching notches 461 receive and engage the left and right resilient latch strips 522, while the left and right recesses 462 receive and engage the left and right protrusions 553. The left and right recesses 462 have upper ledges 4621 that engage lower edges of the left and right protrusions 553 to limit upward movement of the housing 40 in the shield 50. The protrusions 541 on the left and right wall portions 54 are engaged with the apertures 513 on the left and right flanges 512. The contact mounting member 45 is accessible via the insert hole 511 in the front wall portion. Finally, the fastening strips 551 on the left and right flanges 512 and the left and right wall portions 54 are overfolded toward the bottom side 43 around the corner 4631 of the housing 40 such that the fastening strip 551 abuts firmly against the respective ramp 463 and the bottom side 43. Front edges of forward fastening strips 551 abut against rear surface 4312 of T-shaped standoff 431 to restrain forward movement of the shield 50 with respect to the housing 40. Front edges of rearward fastening strips 551 abut against recessed rear edge 432 also to restrain forward moment of the shield 50 with respect to the housing 40. Rear edges of rearward fastening strips 551 abut against forward surface 4331 of rear standoffs 433 to restrain rearward moment of the shield 50 with respect to the housing 40. The shielding member 50 is, thus, mounted closely and securely on the housing 40 to provide effective protection against electromagnetic interference.

In the shielded electrical connector of the present invention, the shielding member 50 is formed in a single punching operation, and can be mounted on the housing 40 by capping on the latter. The various retaining devices of the electrical connector ensure that the shielding member 50 is mounted closely and securely on the housing 40 so as to result in effective protection of contacts 60, 62 against electromagnetic interference. The shielding member 50 is relatively easy to assemble, and the die forming and production operations for the same are convenient to conduct, thereby resulting in reduced costs.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An electrical connector comprising:

a conductive shield including a top wall portion and a front wall portion, a rear wall portion and two side wall portions all unitarily interconnected to said top wall portion, said front wall portion including an insert opening for receiving a mating connector and said side wall portions include outer rear flanges that are folded to abut outer edges of said rear wall and wherein outer edges of said rear wall portion include retaining strips overlapping said outer rear flanges;

an insulative housing received within said shield, said housing having a top side, a bottom side and a contact mounting member disposed in said shield to be accessible through said insert aperture in said front wall portion of said shield;

contacts mounted in said housing having a mating portion disposed in said contact mounting member of said housing for engaging contacts of a mating connector; and a conductive latch unitarily projecting from a front edge of one of said side wall portions and extending along said contact mounting member for engaging a shield of the mating connector.

2. The connector of claim 1 wherein at least one of said side walls of said housing including a notch for receiving said conductive latch.

3. The connector of claim 1 wherein the shield includes a fastening strip descending from a bottom edge thereof, said strip being bent around the bottom of the housing to retain the housing in the shield.

4. The connector of claim 3 wherein the fastening strip is bent around a corner defined between a side and a ramp on the bottom of the housing to allow for overforming of the strip around the corner.

5. The connector of claim 1 wherein the side wall portion of the shield includes an inwardly projecting protrusion and the housing includes a recess that receives said protrusion.

6. The connector of claim 1 wherein said front wall portion of said shield has outer front flanges which fold around front edges of the side wall portions.

7. An electrical connector comprising:

a conductive shield including a top wall portion and a front wall portion, a rear wall portion and two side wall portions all unitarily interconnected to said top wall portion, said front wall portion including an insert opening for receiving a mating connector and said side wall portions include outer rear flanges that are folded to abut outer edges of said rear wall and wherein outer edges of said rear wall portion include retaining strips overlapping said outer rear flanges;

an insulative housing received within said shield, said housing having a top side, a bottom side, two side walls and a contact mounting member disposed in said shield to be accessible through the insert opening in said front wall portion of said shield, said side walls including notches adjacent said contact mounting member;

contacts mounted in said housing having a mating portion disposed in said contact mounting member of said housing for engaging contacts of a mating connector; and conductive latches unitarily supported on front edges of said side wall portions and extending in said notches adjacent said contact mounting member for contacting a shield of the mating connector.

8. The connector of claim 7 wherein the shield includes a fastening strip descending from a bottom edge thereof, said strip being bent around the bottom of the housing to retain the housing in the shield.

9. The connector of claim 8 wherein the fastening strip is bent around a corner defined between a side and a ramp on the bottom of the housing to allow for overforming of the strip around the corner.

10. The connector of claim 7 wherein the side wall portions of the shield include an inwardly projecting protrusion and the housing includes a recess that receives said protrusion.

11. The connector of claim 7 wherein said shield includes outer flanges of said front wall which fold around front edges of the side wall portions.

12. An electrical connector comprising:

a conductive shield including two side wall portions, a top wall portion and a front wall portion with an insert aperture therein said front wall portion of said shield including at least one outer front flange which fold around a front edge of the side wall portion to engage the side wall portion;

an insulative housing received within said shield, said housing having a top side, a bottom side and a contact mounting member disposed in said shield to be accessible through said insert aperture in said front wall position of said shield;

contacts mounted in said housing having a mating portion disposed in said contact mounting member of said housing for engaging contacts of a mating connector; and a conductive latch unitarily supported by one of said side wall portions and extending along said contact mounting member for engaging a shield of the mating connector, and wherein at least a portion of said conductive latch is located behind the front wall portion of said shield.

13. The connector of claim 12 wherein said two side wall portions and said front wall portion uritarily depend from said top wall portion of said shield.

14. The connector of claim 12 wherein the shield includes a fastening strip descending from a bottom edge thereof, said strip being bent around the bottom of the housing to retain the housing in the shield.

15. The connector of claim 14 wherein the fastening strip is bent around a corner defined between a side and a ramp on the bottom of the housing to allow for overforming of the strip around the corner.

16. The connector of claim 12 wherein the side wall portion of the shield includes an inwardly projecting protrusion and the housing includes a recess that receives said protrusion.

17. The connector of claim 12 wherein said shield also includes a rear wall portion unitarily depending from said top wall portion.

18. The connector of claim 17 wherein said side wall portion include outer rear flanges that are folded to abut outer edges of said rear wall portion.

19. The connector of claim 18 wherein outer edges of said rear wall portion include retaining strips overlapping said outer rear flanges.

* * * * *